United States Patent [19]

Joannou

[11] 4,071,690

[45] Jan. 31, 1978

[54] DEVICE FOR GRAPHIC COMMUNICATION

[76] Inventor: Constantinos Joannou Joannou, 2008 Dorval Ave., Ottawa, Ontario, Canada, K1G 2N8

[21] Appl. No.: 735,753

[22] Filed: Nov. 19, 1976

[51] Int. Cl.[2] ..... G08C 21/00

[52] U.S. Cl. ..... 178/18; 179/3

[58] Field of Search ..... 33/1 K, 1 M; 318/568, 318/628; 179/100.2 MD, 3, 2 DP; 35/36; 346/33 M, 74 M; 178/18, 19, 20; 235/151.11

[56] References Cited

U.S. PATENT DOCUMENTS

| | | | |
|---|---|---|---|
| 3,417,202 | 12/1968 | Kolpek | 179/3 |
| 3,505,474 | 4/1970 | Quatse | 179/3 |
| 3,673,329 | 6/1972 | Weld et al. | 179/3 |
| 3,838,211 | 9/1974 | Joannou | 178/18 |
| 3,950,614 | 4/1976 | Anderson et al. | 178/18 |

*Primary Examiner*—Thomas A. Robinson

[57] ABSTRACT

This invention relates to a device which can be used as a telautograph to send graphic messages via telephone lines and provide real time graphic communication between two or more stations. Handwriting and sketches or drawings can be sent and received by the same device. A hard copy of the communicated messages is reproduced at each station. The device or a modified version of the device can also be used to communicate with a computer to record and retrieve graphic information on a tape recorder or it can be used as an X-Y plotter.

10 Claims, 9 Drawing Figures

DEVICE FOR GRAPHIC COMMUNICATION

This invention provides a very versatile device which can be used to send and receive written messages over telephone lines in real time, to establish two-way communication with a computer, i.e. it can operate as a curve digitizer but at the same time it can be used as an X-Y plotter to reproduce information outputted by the computer and it can also be used to store graphic information on magnetic tape, such as handwriting and sketches, and in this way to be used as a teaching aid. Finally, it can be used as an ordinary X-Y plotter.

The main aspect of the device is that it combines the features of a digitizer with those of an X-Y plotter using only one set of servo systems. The present device is an improvement and expansion over a similar device patented by the same inventor under U.S. Pat. No. 3,838,211 dated Sept. 24, 1974.

Present devices of similar nature are not capable of combining the features mentioned above in one unit. For instance, telautograph can only write on small-size paper, they cannot reproduce fine writing because they lack resolution and they are awkward to use because their writing pen is attached to mechanical linkages. There are no digitizers mentioned in the art at present which are capable of receiving as well as sending information to a computer except for the device in the patent mentioned above. Also, the present-day digitizers are very expensive because they use sophisticated techniques to digitize curves. Another problem is to hold a paper flat against the top plate of the device (such as in X-Y plotters). To solve this, they use expensive means, such as vacuum or electrostatic attraction.

It is the object of my invention to provide a device which is capable of real time graphic two-way communication over telephone lines.

Another object of my invention is to provide a device which can be used to record and retrieve graphic information on a magnetic tape recorder.

Another object of my invention is to provide a device capable of digitizing curves, feeding them to a computer and at the same time capable of retrieving curves or graphics from the computer.

Another object of my invention is to provide a device which is easy to use by having the stylus, used by the operator, free from mechanical linkages.

Another object of my invention is to provide a device which can be easily serviced by making the writing arm which drives the reproducing stylus movable.

Another object of my invention is to provide inexpensive means of holding down the paper on the device.

In drawings which illustrate embodiments of my invention,

Figure 1:
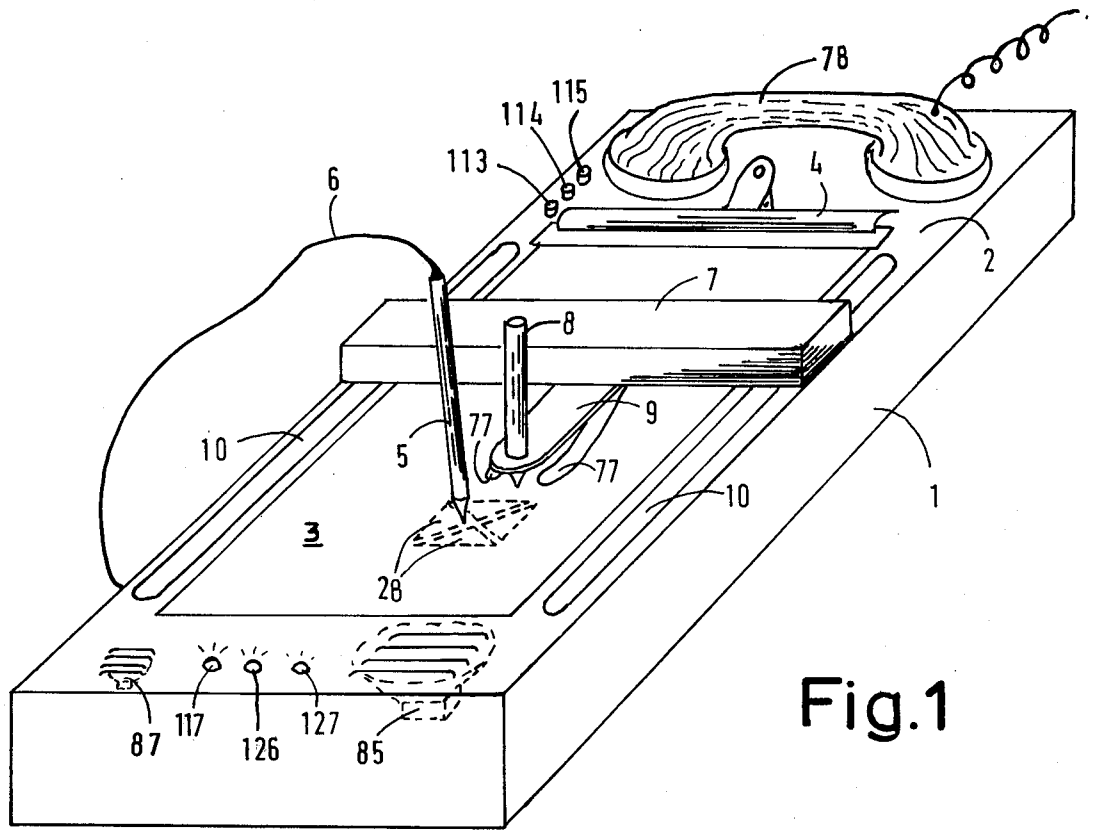
FIG. 1 shows the device as it appears from the outside.

In FIG. 1, 1 is the outer case of the device which consists of a flat rectangular box containing the various mechanisms. The top cover 2 of this case is made of a sheet of dielectric material on which a piece of paper 3 is placed and held in place by holder 4. 5 is a first writing stylus for writing on paper 3. This stylus is attached via a cable 6 to an RF oscillator inside the box and is used by the operator to send messages. 7 is the removable writing mechanism which operates a second writing stylus 8 via arm 9. The second stylus reproduces the writing which is received by the device in the form of electrical signals. The dielectric cover 2 has slots 10 cut along the edges through which the mechanism 7 is driven by the servo systems inside the case, as will become apparent later. 28 are sensing elements under the top cover. 78 is a telephone receiver. 85 is a loudspeaker and 87 is a microphone. 113, 114 and 115 are pushbutton controls for controlling the device. 117, 126 and 127 are indicator lights indicating the status of the device.

Figure 2:
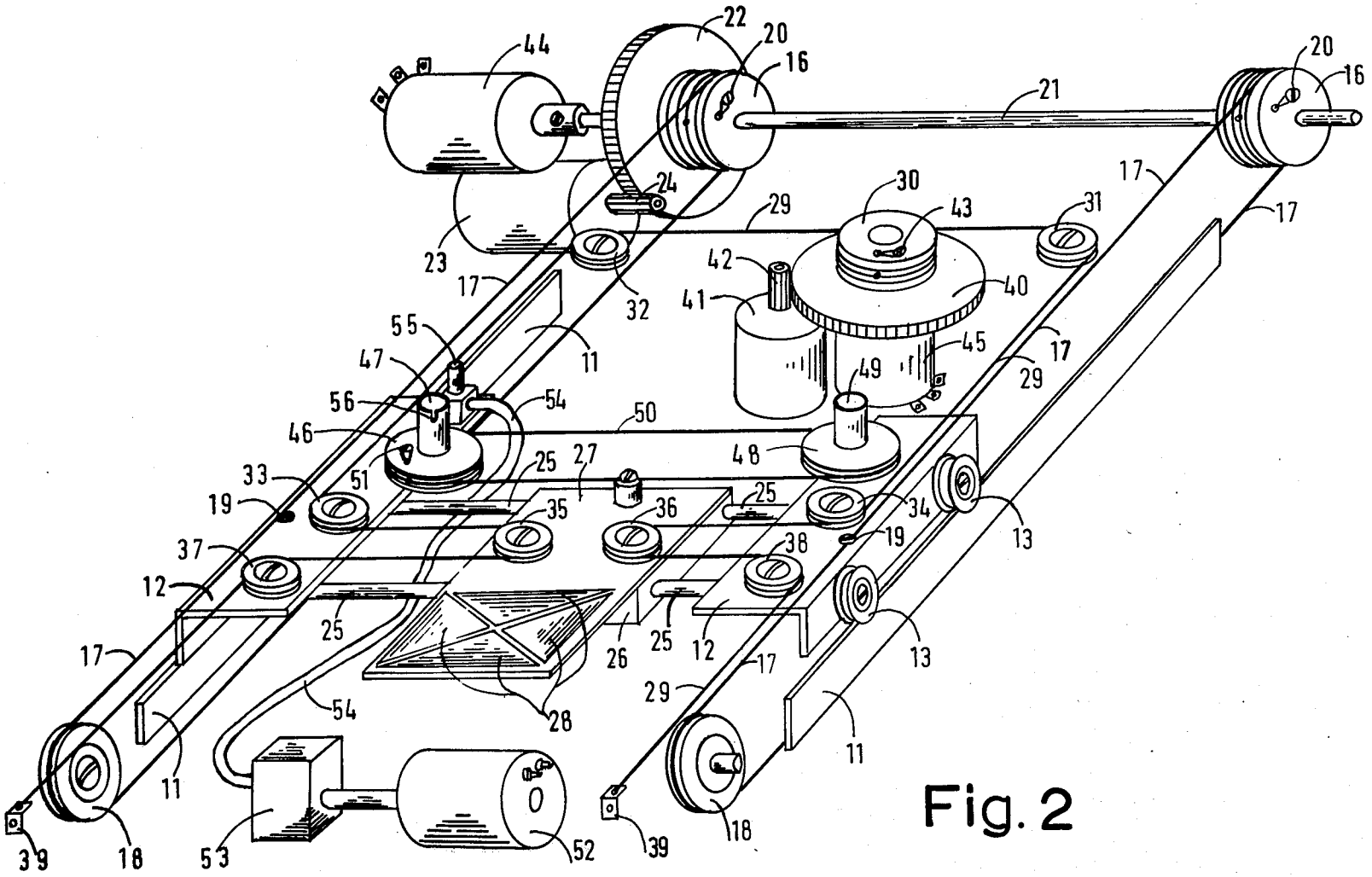
FIG. 2 shows the mechanism inside the case of the device.

In FIG. 2, 11 are rails on which angular members 12 can roll with the aid of wheels 13. Cylinders 16 are linked by chords 17. Chords 17 also link pulleys 18. Chords 17 are affixed to members 12 by screws 19. Also, chords 17 are wound several times around cylinders 16 and at some point the chords are affixed to cylinders 16 by screws 20. In this way the chords cannot slip around cylinders 16. 21 is a shaft which passes through the centres of cylinders 16 and cylinders 16 are affixed to it. 22 is a spur gear also affixed to shaft 21. 23 is a servomotor which drives cylinders 16 via pinion gear 24, spur gear 22 and shaft 21. In this arrangement, when cylinders 16 turn, members 12 are pulled by chords 17 and move along rails 11 ($y$-direction). Angular members 12 are connected together by parallel rails 25 which, in this case, are of circular cross-section. On rails 25 rides member 26 which is provided with holes for the rails to pass through it. On top of member 26 is a plate of non-conducting material 27 which holds four sensing electrodes 28. Chord 29 is wound several times around cylinder 30 and links pulleys 31 to 38 and its two ends are fixed to brackets 39 which, in turn, are fixed to the case of the device. Pulleys 31 and 32 are attached to the case of the device by bearings. Pulleys 33, 34, 37 and 38 are attached to members 12 via bearings and pulleys 35 and 36 are attached to member 26 also via bearings. The middle of chord 29 is affixed to cylinder 30 by screw 43. Spur gear 40 is affixed to cylinder 30. In this arrangement, when cylinder 30 turns, one side of chord 29 is tensioned and the other side is loosened and, as a result, member 26 moves along rails 25 ($x$-direction). Note that with this arrangement, when motor 23 turns, members 12, rails 25 and therefore member 26 moves in the $y$-direction only, and when motor 41 turns, member 26 moves in the $x$-direction only. 44 is a multi-turn potentiometer attached to shaft 21 and, therefore, responding to the $y$-movement of member 26. 45 is a multi-turn potentiometer attached to cylinder 30 and, therefore, responds to the $x$-movement of member 26. 46 is a cylinder attached to hollow shaft 47. Shaft 47 is attached to left member 12 via bearings and is free to rotate. Pulley 48 is attached to hollow shaft 49. Shaft 49 is attached to right member 12 via bearings and it is also free to rotate. Chord 50 is wound several times around cylinder 46 and it also passes around pulley 48. Chord 50 is attached to cylinder 46 by screw 51. Chord 50 is also attached to member 26 by a post. In this arrangement, when member 26 moves in the $x$-direction, shafts 47 and 49 rotate, and when members 12, rails 25, etc. move in the $y$-direction, shafts 47 and 49 also move in the $y$-direction. Shafts 47 and 49 pass through slots 10 (FIG. 1) on top of the device and drive the writing mechanism 7 which, in turn, operates the second writing stylus. 52 (FIG. 2) is a solenoid which operates airpump 53. When airpump 53 is activated, it forces air through flexible tube 54. Tube 54 is connected to tapered coupling 55. This mechanism operates bellows in the writing mechanism 7 which lower the second writing stylus.

Figure 3:
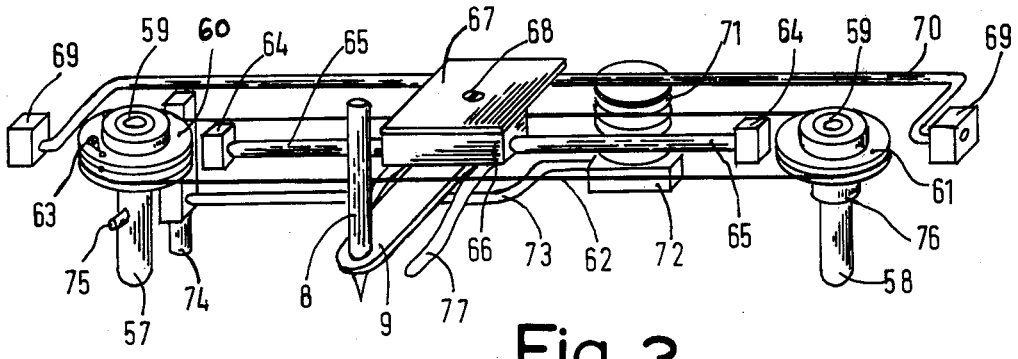
FIG. 3 shows the mechanism of the removable writing arm.

The removable writing mechanism 7 is shown in detail in FIG. 3. 57 and 58 are two shafts which are rounded at their lower ends and their diameter is such that they fit into hollow shafts 47 and 49 (FIG. 2). The upper ends of shafts 57 and 58 are provided with bearings 59 by which they are mounted to the case of the arm. Cylinder 60 is attached to shaft 57 and pulley 61 is attached to shaft 58. Chord 62 is wound several times around cylinder 60 and once around pulley 61. Chord 62 is also affixed to cylinder 60 by screw 63 so that it cannot slip around it. 64 are two blocks supporting rod 65 on case of mechanism 7. 66 is a rectangular member which is arranged to slide along shaft 65. 9 is the second stylus holder and it is attached to member 66. 8 is the second stylus which is attached to holder 9. 67 is a plate attached to the top of member 66 and extending towards the rear of 66. Chord 62 is attached to plate 67 and member 66 by screw 68 so that when shaft 57 rotates, chord 62 pulls member 66 and slides it along shaft 65 (i.e. in the $x$-direction). Bent shaft 70 is loosely supported by blocks 69 which, in turn, are fixed to the case. Shaft 70 is bent so that it forms one bell crank on each end and since its ends loosely fit into blocks 69, its middle part can be lifted and lowered by air bellows 71. Bellows 71 have one end attached to shaft 70 and the other end attached to the outer case by base 72. Bellows 71 are supplied with compressed air via pipe 73 and tapered coupling 74, which is attached to the other end of pipe 73. 75 is a key attached to shaft 57 which is arranged to fit into slot 56 (FIG. 2) when shaft 57 is fitted into hollow shaft 47. 76 is a collar attached to shaft 58 which, when shaft 58 is fitted into hollow shaft 49, rests on top of shaft 49 and thus, together with key 75, assures the position of the arm mechanism with respect to the surface 2 of the device. Spring elements 77 are attached to the bottom of member 66 and they have a dual purpose, first, to hold paper 3 flat against the top surface of the device and, second, to provide lifting force for the pen when bellows 71 are deflated. When arm mechanism 7 is plugged into the device and shafts 57 and 58 mate with shafts 47 and 49, tapered coupling 74 is arranged to mate with tapered coupling 55, thus closing the connection between air pump 53 and bellows 71.

Figure 4:
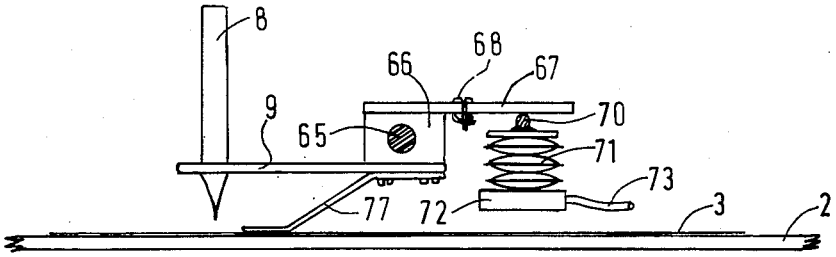
FIG. 4 is a cross-sectional view of the writing arm mechanism.

Operation of the system for lowering and lifting the second stylus on and off the paper is as follows (FIG. 4): When solenoid 52 is activated, there is air pressure in pipe 73 and bellows 71 are inflated. Shaft 70 is lifted by the action of the bellows and pushes against plate 67. Member 66 rotates around shaft 65 thus lowering the second stylus 8 against the force of spring elements 77. When the solenoid is de-energized and the bellows are deflated, spring elements 77 force stylus 8 off the paper. Note that the location of the centre of sensing elements 28 is several centimeters in front of the writing point of stylus 8.

Operation of the device is as follows: To send or record a hand written message, an operator writes with stylus 5 on paper 3. Stylus 5, as will be shown later, is energized with an RF signal which is carried to the stylus by cable 6. The sensing elements under the top cover pick up the RF signal, amplify it and cause the servomechanisms to drive the sensing elements and to follow the movements of stylus 5. Stylus 8 is also driven by the servomechanisms in unison with the sensing elements but, since the sensing elements are always in front of stylus 8, stylus 8 does not interfere with the writing process. When the device is receiving a message, the same servomechanisms are used to drive stylus 8 and reproduce the received message.

Figure 6:
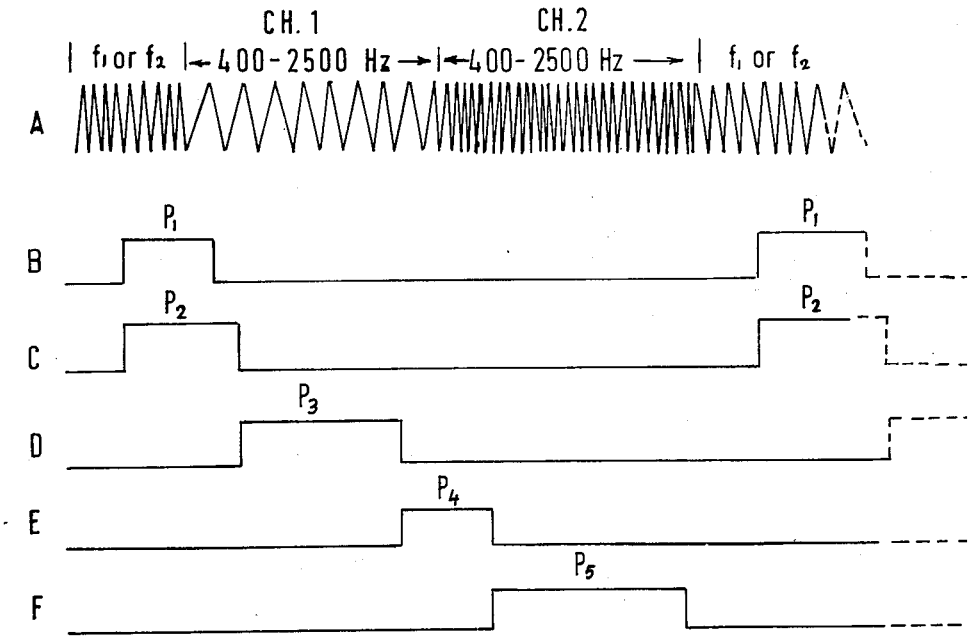
FIG. 6 shows the signals, in time sequence, produced by the device when used as a telautograph.
Figure 5:
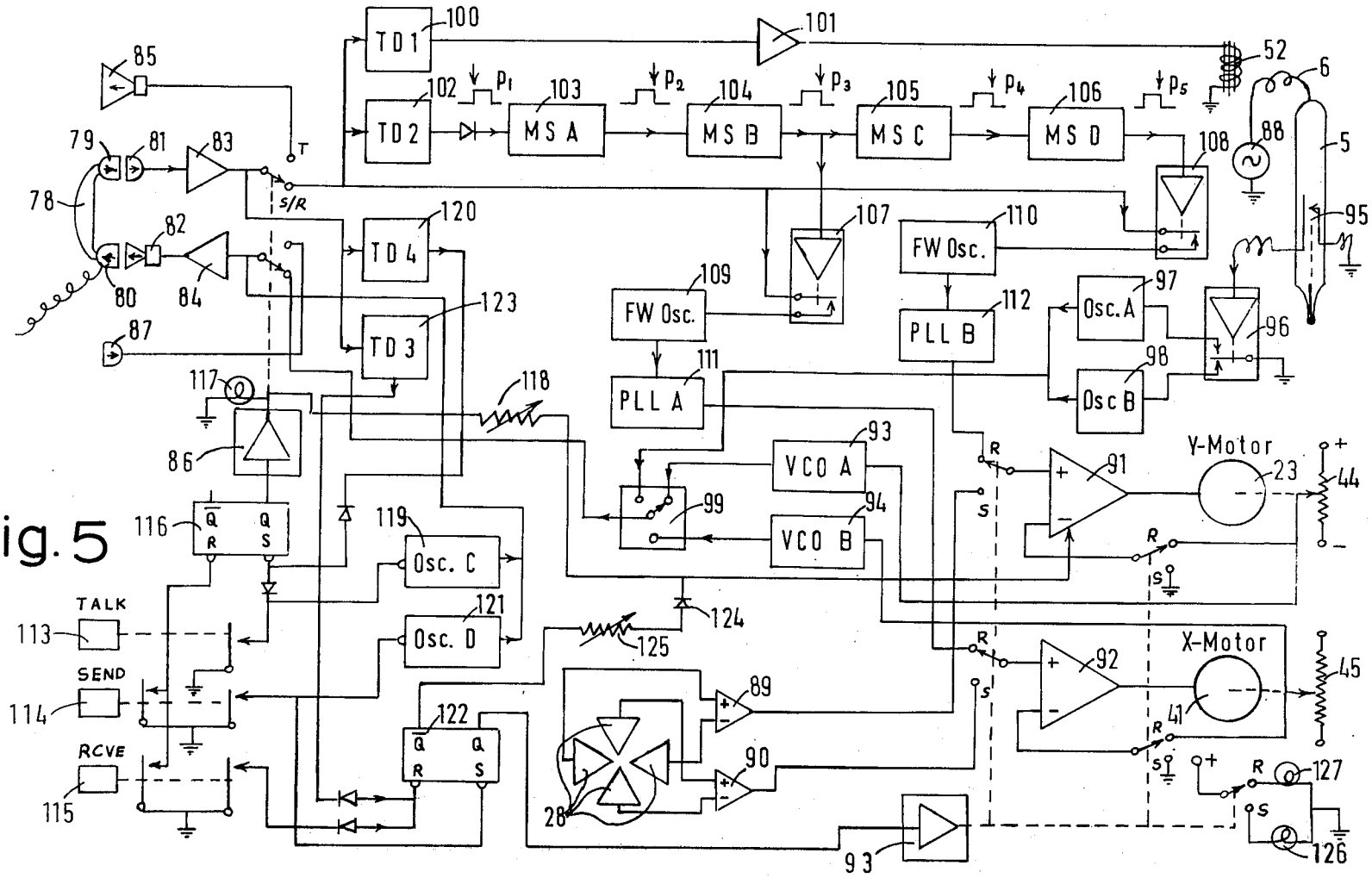
FIG. 5 shows diagrammatically the electrical/electronic system of the device when used as a telautograph.

The electronics part of the device, when used as a telautograph, is shown diagrammatically in FIG. 5. The device operates in three modes, "talk," "send" and "receive". 78 is the telephone receiver, 79 and 80 are its earphone and microphone, respectively. 81 is a microphone, acoustically coupled to earphone 79, and 82 is a small loudspeaker, acoustically coupled to microphone 80. Items 81 and 82 form what is known as an "acoustic coupler". 83 is an amplifier which amplifies signals from microphone 81 and 84 is an amplifier driving speaker 82. When the system is in the "talk" mode of operation, signals out of amplifier 83 are switched to speaker 85 by electronic switch 86. Similarly, the input of amplifier 84 is switched to microphone 87. In this way, when the telephone receiver is placed on the acoustic coupler at the top of the device, conversation with the party called can be carried on in a similar way as with an intercom system. When the system is in the "send" mode of operation, the operator may use stylus 5 to write with. Stylus 5 is connected to RF oscillator 88 via co-axial cable 6. The inside conductor of cable 6 is connected to the writing point of stylus 5, which is insulated from the outer shell, and thus the writing point is radiating RF energy. While writing, sense elements 28, which are located under the paper and under the top dielectric cover of the device, pick up the RF energy from the stylus (like an antenna). 89 and 90 are differential RF amplifier detectors which are located under sensing elements 28 (See U.S. Pat. No. 3,838,211) and mounted on member 27 so that the connecting wires from the elements are kept short to eliminate extraneous RF and noise reception. Amplifiers 89 and 90 produce a DC output voltage which is positive or negative depending on the relative signal induced in their corresponding pair of sensing elements. For instance, if the upper element of amplifier 89 receives stronger signals than the lower element, the output voltage will have positive polarity. If the lower element receives a stronger signal, the amplifier output voltage will have negative polarity. If the signals picked up by the two elements are of equal strength, then the output of the amplifier will be zero. The voltages out of amplifiers 89 and 90 are connected to the positive inputs of servo-amplifiers 91 and 92 via electronic switch 93. The negative inputs of amplifiers 91 and 92 are connected to ground also via switch 93. In this arrangement, while the operator writes on the paper, signals picked up by elements 28 are amplified and applied to motors 23 and 41 causing the motors to rotate and move members 26, 27 and sensing elements 28 under stylus 5 so that the RF signal is received equally among the pairs of sensing elements. In this way, the centre of the sensing elements follows stylus 5. Potentiometers 44 and 45 are also driven by the motors and produce DC voltages corresponding to the *x* and *y* positions of sensing elements 28. These voltages are fed to voltage controlled oscillator 93 and voltage controlled oscillator 94. These oscillators produce frequencies well within the band pass of the telephone system, say from 400 Hz to 250 Hz. While writing, a switch 95 in stylus 5 closes any time the stylus is pressed against the paper. Closing of this switch causes electronic switch 96 to disable oscillator 97 and enable oscillator 98. These oscillators produce frequencies at the upper end of the telephone band, say 260 Hz and 290 Hz, respectively. The outputs of these oscillators are connected together and are fed to electronic commutator 99 together with the outputs of oscillators 93 and 94. The output of commutator 99 consists of the frequencies of 97 or 98, 93 and 94 produced in sequence. The output of commutator 99 is connected to the input of amplifier 84 via switch 86 and from there is transmitted out on the telephone line via speaker 82 and microphone 80. The transmitted (or received) signal is shown in FIG. 6A. When the device is operating in the "receive" mode, signals arriving at earphone 79 are picked up by microphone 81 and are amplified by amplifier 83. From there they are fed to the receiving circuits via electronic switch 86. TD1 100 is a tone decoder which produces a pulse when it receives a frequency corresponding to the lowering of the stylus 5 onto the paper (i.e. the frequency of oscillator B 98 in the sensing device). The output of TD1 is fed to solenoid amplifier 101 which drives solenoid 52 which lowers stylus 8 on the paper. TD2, 102, is another tone detector which is set for wider bandwidth and it accepts frequencies corresponding to oscillator A 97 and oscillator B 98, so that no matter which frequency is sent to the device, TD2 will produce a pulse P1 at the beginning of every frequency cycle of the signals received. The pulse P1, produced by TD2, is used as a synchronizing pulse and its leading edge is used as a trigger for monostable A 103 (See FIG. 6B). The trailing edge of pulse P2 produced by monostable A, 103, triggers monostable B 104, the trailing edge of pulse P3 produced by monostable B triggers monostable C, 105, and the trailing edge of pulse P4 produced by monostable C triggers monostable D, 106. Monostable D produces pulse P5. Pulses P3 and P5 are used to drive electronic switches 107 and 108. Switches 107 and 108 connect the amplified incoming signal to flywheeling oscillators 109 and 110. The flywheeling oscillators are synchronized with the input frequency during the time they are switched to the incoming signal and after their input is switched off, they keep producing a steady voltage of which the frequency is that of the momentarily connected input signal. Pulses P2 and P4 are used as delay pulses so that pulses P3 and P5 coincide in time with the middle of the time intervals during which signals corresponding to voltage controlled oscillators VCO A and VCO B were received. In this way, the two flywheeling oscillators produce a steady AC voltage with frequency corresponding to those of VCO A and VCO B in the sending device. These voltages are fed to phase lock loop A, 111, and phase lock loop B, 112, which in turn produce DC voltages corresponding to the frequencies fed to them. From the above explanation, it is easy to see that the DC voltages produced by PLL A and PLL B correspond to the DC voltages produced by corresponding potentiometers 45 and 44 in the sending device. Finally, the DC voltages produced by PLL A and PLL B are fed to the positive inputs of servo-amplifiers 92 and 91 where they are used as reference voltages for the servo systems. Amplifiers 92 and 91 drive motors 41 and 23 which drive potentiometers 45 and 44. The DC voltages produced by potentiometers 45 and 44 are fed to the negative inputs of the servo amplifiers. In this way, the motors turn until the voltages from potentiometers 45 and 44 are equal to the DC voltages produced by PLL A and PLL B and then the motors will stop. Since stylus 8 is mechanically driven in the *x*-direction by motor 41 and in the *y*-direction by motor 23, stylus 8 will follow the movement of stylus 5 in the remote sending device.

The controlling circuits of the device used as a telautograph are as described below: Three push buttons are available to the operator. One labelled "TALK," 113, one labelled "SEND," 114, and one labelled "RECEIVE," 115. Each has contacts which are normally open. When the "TALK" button is pressed, R-S flip-flop 116 is set, electronic switch 86 is actuated and it connects the output of amplifier 83 to speaker 85 and the output of microphone 87 to the input of amplifier 84. At the same time an indicator light 117, mounted on the front of the device and driven by switch 86, lights up to indicate the "Talk" mode of operation. Also, a voltage supplied by switch 86 is applied to *y*-servo-amplifier 91 via adjustable resistor 118. This voltage is applied to the *y*-servo-amplifier to cause the servo system to move writing mechanism 7 to the top of the device away from the paper so that any written material on the paper will be fully exposed while conversation is going on. Also, when the "TALK" button is pressed, oscillator C, 119, is enabled sending a tone out on the telephone line to be received by the receiving device. When this tone is received it is sensed by tone decoder 4, 120, in the receiving device. When this happens, TD 4 produces an output voltage which is used to set flip-flop 116 in the receiving device thus switching it into its "Talk" mode of operation. When the "SEND" button 114 is pressed, flip-flop 116 is reset and oscillator D is enabled. At the same time flip-flop 122 is set and its Q output operates electronic switch 93 which performs the appropriate connections to switch the device into its "Send" mode as described before. Oscillator D produces a tone which is sent out on the telephone line. The frequency of this tone is in the pass band of tone decoder 3, 123, in the receiving device at the other end of the line. When this tone is received, the output of TD3 in the receiving device will reset flip-flop 122 also in the receiving device and will set the receiving device in its "Receive" mode of operation. Thus when one device is switched into its "Send" mode of operation, the other device at the other end of the telephone channel is switched to its "Receive" mode of operation. When the receive button 115 is pressed, flip-flops 116 and 122 are reset. When flip-flop 122 is in its reset mode, switch 93 is operated and switches the device into its "Receive" mode, as described before. Also, in this state of flip-flop 122, a voltage out of $\overline{Q}$ is applied to *y*-servo-amplifier 91 via diode 124 and variable resistor 125. This voltage is summed with the positive input voltage in the amplifier to cause a constant $y$-shift of the servo system so that stylus 8 will write in the same $y$-coordinates as stylus 5 in the sending device. This is very important if the graphic information sent is to be identical to the one received at the other end of the telephone line. 126 and 127 are indicator lights mounted on the top of the device. They are energized via switch 93 and they indicate when the device is in its "Send" or "Receive" mode of operation.

Operation of the device used as a telautograph is as follows: After connection is established between two telephone stations, the telephone receivers are placed on the top of the device on the acoustic coupler. The two parties can still communicate by voice if either of the two presses his "TALK" button momentarily. This action will switch both devices into the "Talk" mode of operation. To send graphic information, the sending party presses the "SEND" button momentarily. This action switches the sending device into its "Send" mode and the receiving device in "Receiving" mode. The "RECEIVE" button is used when the device receives signals from other sources, such as a tape recorder.

Figure 7:
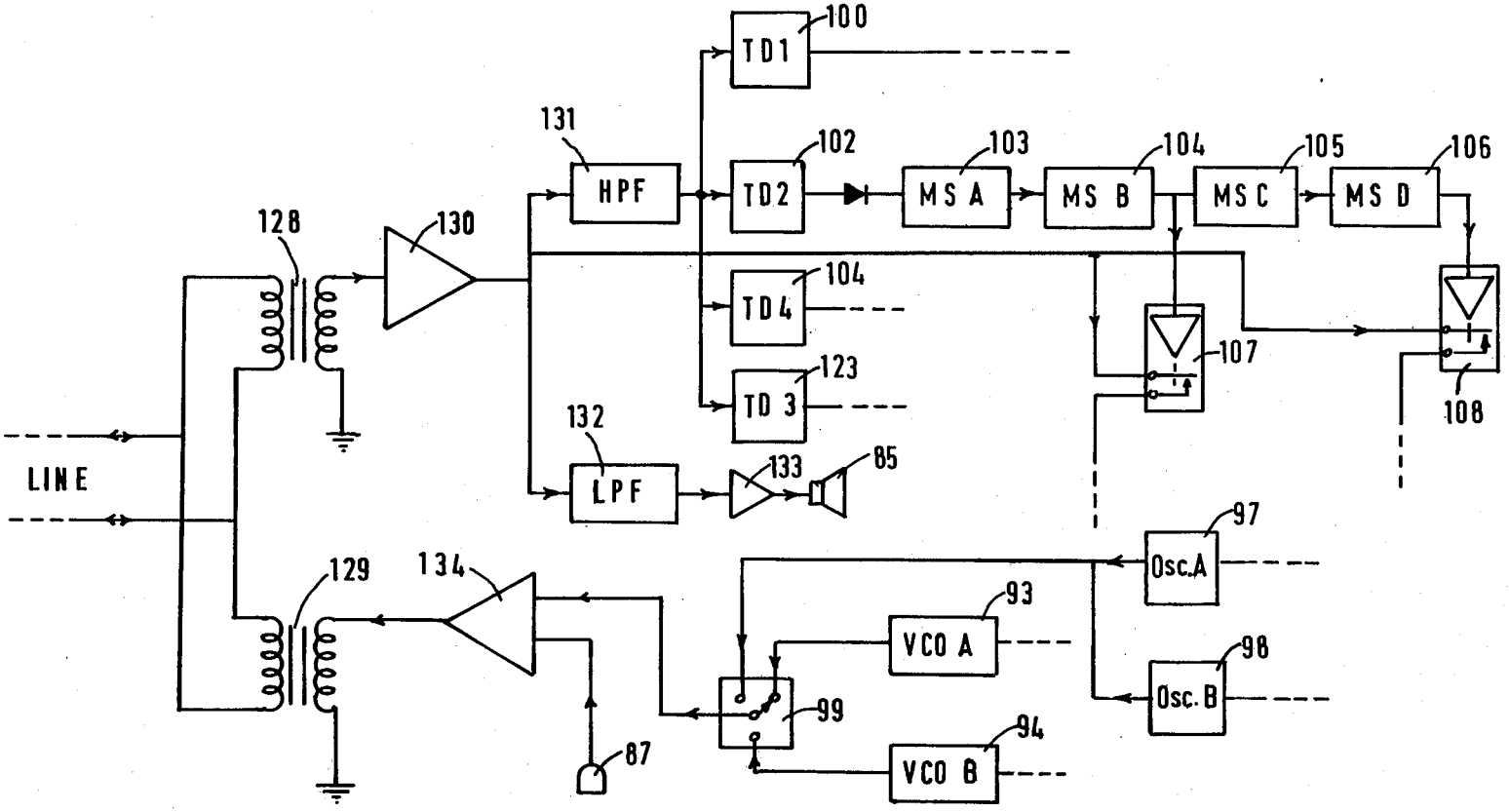
FIG. 7 shows another arrangement of the electrical/electronic part which makes the device capable of simultaneously transmitting and receiving speech and graphic information.

Another variation of the electrical/electronic part of the device is shown in FIG. 7. This arrangement may be used where a wider band channel is available, such as those used for intercomes within a building or between closely located buildings or radio or microwave channels. By using the arrangement of FIG. 7 voice communication can be carried on at the same time as graphic communication. This is achieved by frequency multiplexing. In this arrangement, transformers 128 and 129 are used to couple into the line instead of the acoustic coupler. Amplifier 130 amplifies incoming signals and passes them on to a high pass filter 131 and to a low pass filter 132. Low pass filter 132 allows the lower frequencies to go to speaker 85 via amplifier 133. High pass filter 131 allows the higher frequencies to go to the circuits which drive stylus 8 as described before. Amplifier 134 receives signals from commutator 99 and from microphone 84 and passes them to the line via transformer 129. It can be seen from the above that frequency multiplexing can be achieved since the voice signals are separated from the rest of the signals by filters and they do not interfere with each other.

The arrangement of FIG. 7 can also be employed in cases where the device is used as a teaching aid and voice and graphics are recorded on a tape recorder and played back by students. In this case, the output of amplifier 134 is connected to the input of a tape recorder, and the input of amplifier 130 is connected to the output of the tape recorder.

It is recognized that in the system described above, any fluctuation in tape recorder speed will result in fluctuations of the voltages produced by the phase lock loops. This will cause an erratic writing. To minimize this problem, another tone of fixed frequency can be recorded on the tape and during playback this tone is fed to another phase lock loop. The DC voltage out of this phase lock loop will vary as the tape speed varies and it can be added to (or subtracted from) the voltages fed as correcting voltage to the servo amplifiers in the proper proportion to eliminate the erratic fluctuation in writing.

Figure 8:
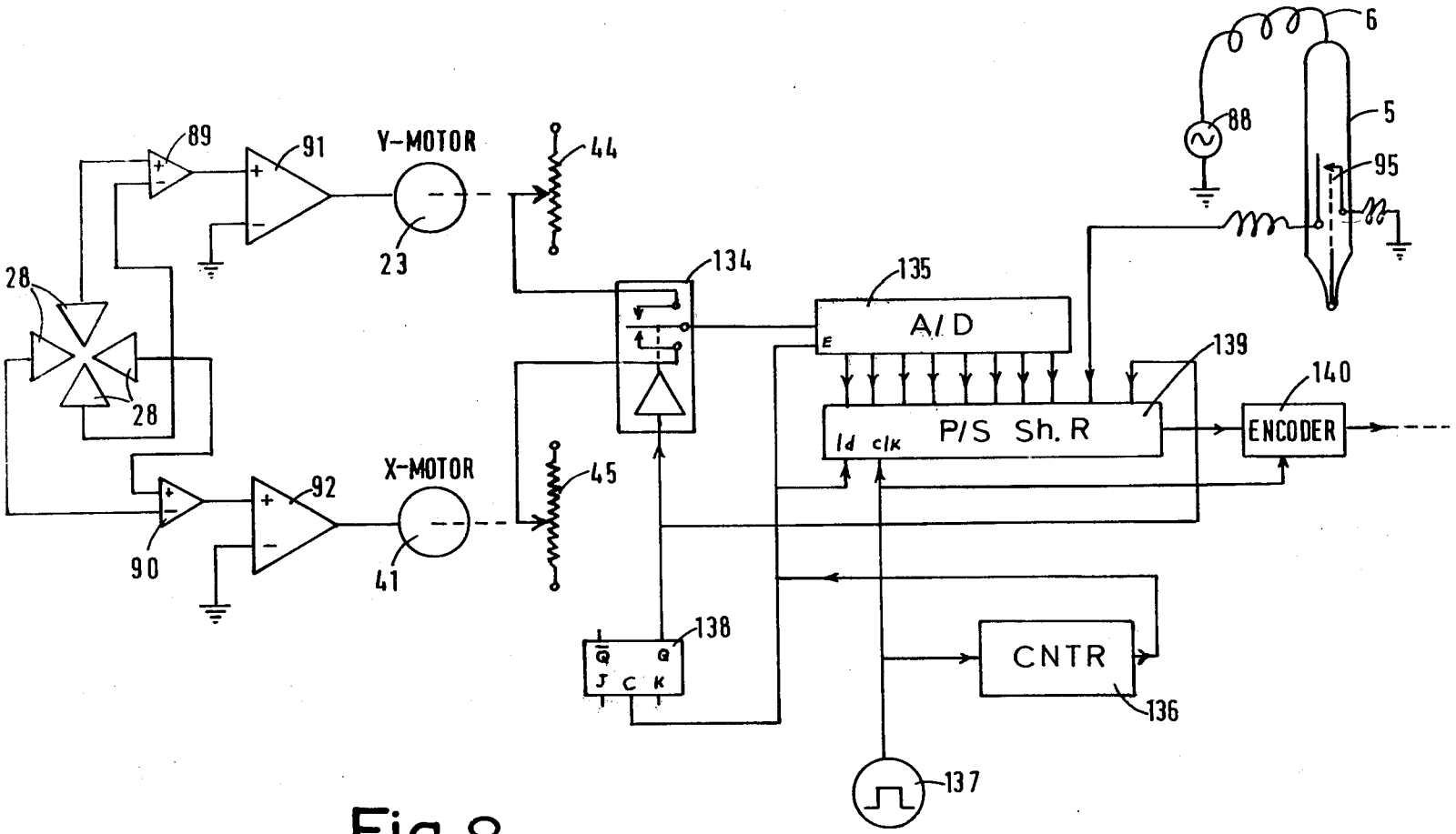
FIG. 8 shows another arrangement of the electrical/electronic part of the device operating in send mode and in which servo signals are converted into digital data for transmission.

FIG. 8 shows the electical/electronic part of the device in "Send" mode when used as a digitizer for deriving digital $x$-$y$ coordinates of points on curves traced or written on the device and feeding them to a computer or a tape recorder. When writing or tracing a curve with stylus 5, sensing elements 28 sense the location of the stylus and cause servomotors 41 and 23 to position continuously the sensing elements under stylus 5, thus following its movement as described before. DC voltages produced by potentiometers 44 and 45 are switched alternately by electronic switch 134 to Analog-to-Digital converter 135. A/D converter 135 is enabled by the last count of counter 136 which divides down clock pulses from clock 137. The output of counter 136 also connects to the clock input of J-K flip-flop 138 and to the load input of shift register 139. In this arrangement, at the end of every full count of counter 136, A/D converter 135 is enabled, shift register 139 is loaded from the A/D converter and switch 134 changes state. Shift register 139 also receives bids from the Q output of JK flip-flop 138 and the switch 95 in stylus 5. The first bid is a flag to tell the computer which channel ($x$ or $y$) the data are coming from, and the second bid is a flag to tell whether stylus 5 is pressing against the paper or not. Serial data out of shift register 139 and clock pulses from clock 137 are connected to encoder 140 (if required) to be put into any one of several well-known formats for transmission over lines or to be recorded on magnetic tape.

Figure 9:
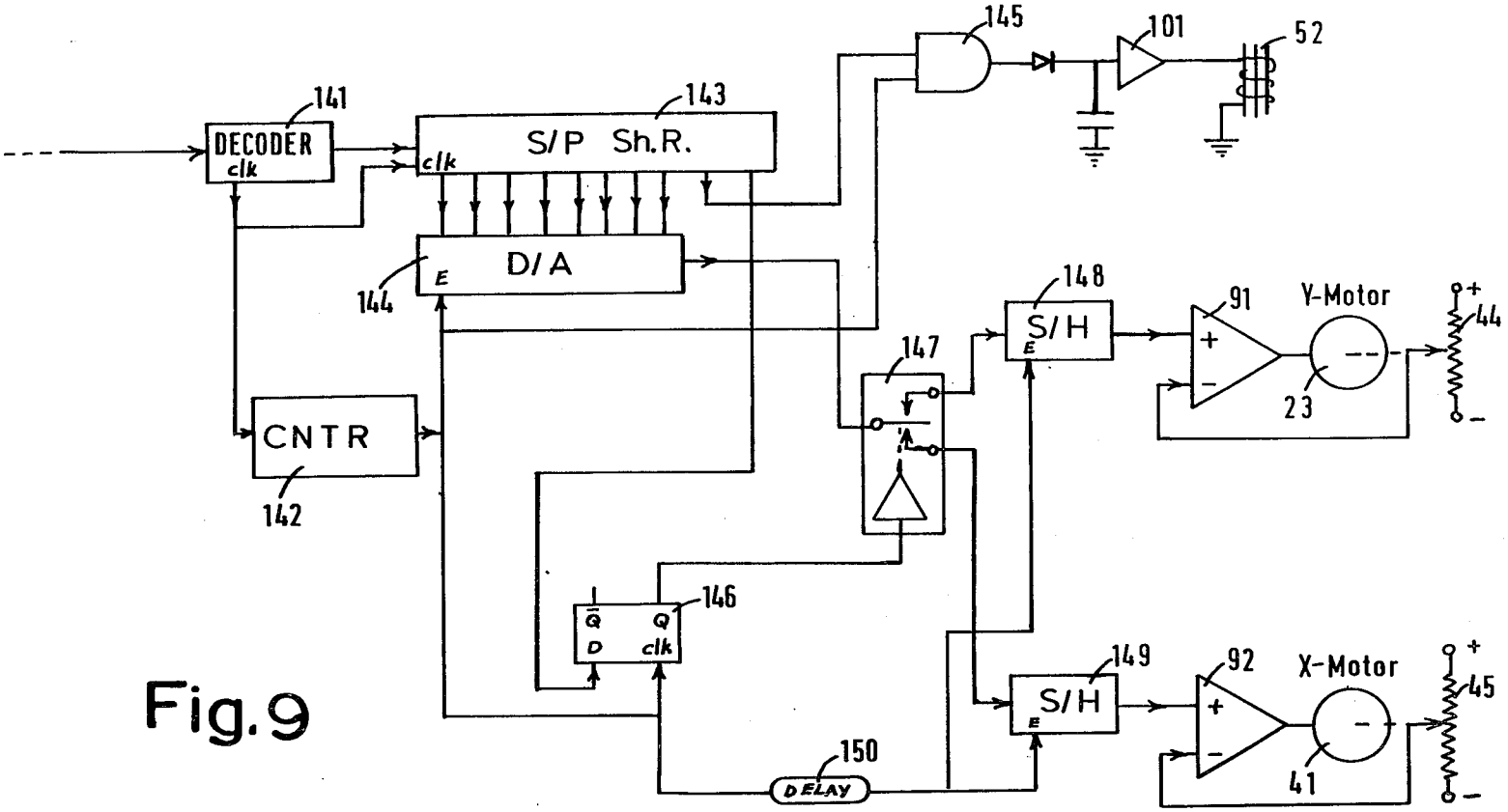
FIG. 9 shows the arrangement of FIG. 8 in receive mode of operation.

FIG. 9 shows the electrical/electronic part of the device used in "Receive" mode when used as a digitizer. Data from the computer or tape recorder arrive at decoder 141 which changes the data received back into normal format and at the same time extracts the previously encoded clock pulses. The clock pulses are connected to counter 142 and the data to shift register 143. S/R 143 also receives clock pulses from the decoder. At the end of every full count of counter 142, when S/R 143 is full, D/A converter 144 and gate 145 are enabled and D-type flip-flop 146 is clocked. This causes the D/A converter to produce a DC output voltage corresponding to the data in the shift register, the Q output of flip-flop 146 to go high or low depending on whether the flag bid identifying the channel is high or low, and the output of gate 145 to go low or high depending on the flag bid indicating whether the writing stylus should engage the paper or not. The Q output of flip-flop 146 is connected to electronic switch 147 which connects the D/A output either to sample/hold 148 or sample/hold 149. S/Hs 148 and 149 are enabled after a delay (150) by the output of counter 142. In this way, the outputs of the two sample/hold circuits reproduce the voltages encoded in the data received. These voltages operate the two servo systems which drive stylus 8.

The arrangements described in FIG. 8 and FIG. 9 can also be used to send graphic information back and forth between two similar devices if appropriate switching is incorporated to switch the devices into "Send" and "Receive" modes of operation.

Finally, the device can be adapted to fit on an overhead projector and be used as a class teaching aid by making the top cover 2 and the bottom of the case (FIG. 1 and 2) out of transparent material and using transparent sheets for writing. For this application, the electronic components, printed circuits, etc. may be built away to one side of the device so that they do not cast a shadow during projection. The only shadows which will then appear in the field of view will be those of writing mechanism 7 and the sensing unit, but they can be made to move away from the field of view while the teacher is explaining his writing.

What I claim is:

1. A device for sending or receiving graphic information comprising:

a. a plate of dielectric material on which writing paper may be affixed;

b. a first stylus for writing graphic information, said stylus being made to radiate an RF signal;

c. a movable electrode assembly located underneath said dielectric plate and arranged to sense said RF signal radiated by said first stylus;

d. servo systems arranged to move said electrode assembly in the $x$ and $y$-directions in response to signals received by said electrode assembly, and in such a way as to follow said first stylus;

e. potentiometers connected to said servo systems via linkages and arranged to produce electrical signals corresponding to positions of said electrode assembly;

f. a first set of two shafts connected to said servo systems via linkages and arranged to be accessible through slots cut on each side of said dielectric plate, said shafts being arranged to move along said slots when one of said servo systems is operated and said shafts being arranged to rotate about their axes when another of said servo systems is operated;

g. a stylus holding assembly comprising a second stylus for reproducing graphic information, said assembly being removably attached to said first set of shafts so that when said first set of shafts rotates and/or moves along said slots said second stylus moves in the $x$ and/or $y$-directions, said stylus holding assembly providing means for lowering and lifting said second stylus on and off said paper;

h. means for converting said signals produced by said potentiometers into suitable form for transmission through telephone line and/or into binary data for feeding into a computer or into signals capable of being recorded on and retrieved from a magnetic tape;

i. means for converting signals received from a computer, tape recorder, or from another similar device into signals suitable for operating said servo systems.

2. A device as described in claim 1 in which said stylus holding assembly comprises a narrow rectangular case, a second set of shafts rotatably attached to each end of said case; a cylinder affixed to one of said shafts; a pulley affixed to the other of said shafts; a chord wound around said cylinder, said chord also linking said pulley; and said second set of shafts being removably attached via said slots to said first set of shafts; a stylus holding member to which said second stylus is attached and said stylus holding member being slidably attached to a rail and said stylus holding member being attached to a point on said chord; a long actuating member attached by linkages to said stylus holding member; air bellows attached to said actuating member and arranged so that when said air bellows are inflated said air bellows cause said actuating member to move and cause said stylus holding member to move in such a way as to lower or lift said second stylus; a tube for supplying compressed air to said bellows connected at one end to said bellows and at the other end to a coupling located near one of said shafts of said second set of shafts and said coupling being arranged to engage with a second coupling attached to a movable mechanism inside said device and said second coupling being connected to an airpump also inside said device and said airpump being operated by a solenoid.

3. A device as described in claim 1 in which means are provided for converting said signals from said potentiometers into voltages having frequency or period corresponding to said potentiometer signals, means for producing a third voltage of fixed frequency any time said first stylus is pressed against said paper, means for transmitting said voltages in sequence over transmission lines, means for receiving voltages of varying frequency in sequence and processing them so as to produce signals corresponding to said received voltages suitable for driving said servo systems and said solenoid.

4. A device as described in claim 1 in which means are provided for converting said signals produced by said poentiometers into digital signals and means for converting said digital signals into a format suitable for transmission over transmission lines; means for receiving digital signals and means for processing them so as to produce signals suitable for driving said servo systems.

5. A device as described in claim 1 in which an acoustic coupler is incorporated into the device to facilitate connection between said device and a telephone line, said acoustic coupler comprising a microphone and a loudspeaker.

6. A device as described in claim 1 in which three switches, a microphone and a loudspeaker are provided and arranged so that when the first switch is operated, electrical connections are made so that when said device is interconnected with a remote device, aural communication may be established between said two devices via said microphone and said loudspeaker and at the same time said stylus holding assembly operating said second stylus moves to one side of said paper so as to expose any written material on said paper and when the second switch is operated electrical connections are made so that graphic information may be sent to said remote device and at the same time electrical connections are made in said remote device so as to enable said remote device to receive and record said graphic information and when the third switch is operated electrical connections are made so as to enable said device to receive and record incoming graphic information.

7. A device as described in claim 1 in which said dielectric plate is made of transparent material and the bottom of the case containing said device is also made of transparent material.

8. A device as described in claim 1 operable in "send" and "receive" modes of operation into which a loudspeaker and microphone are incorporated to permit simultaneous aural and graphic communication and when said device is in "send" mode of operation, signals derived from said potentiometers are multiplexed with voice signals derived from said microphone and the composite signal produced by the multiplexing process is transmitted to another station, and when said device is in "receive" mode of operation means are provided to de-multiplex the incoming signal and separate said voice-derived signals from said potentiometer-derived signals and use said voice-derived signals to drive said loudspeaker and said potentiometer-derived signals to drive said servo systems.

9. A device as described in claim 1 and operable in "send" and "receive" modes of operation and providing a distance between said sensing elements and said second stylus and having means for compensating for said distance when said device is in said "receive" mode of operation.

10. A device as described in claim 1 in which said stylus holding assembly is provided with spring elements and arranged so that said spring elements press against said paper in order to keep it flat against said dielectric plate and at the same time provide a lifting force for lifting said second stylus off said paper.

* * * * *